US006743041B2

(12) United States Patent
Holzer et al.

(10) Patent No.: US 6,743,041 B2
(45) Date of Patent: Jun. 1, 2004

(54) ADAPTOR FOR SHOCKPROOF SOCKET

(75) Inventors: Walter Holzer, Meersburg (DE); Boyd Berends, Holland, MI (US)

(73) Assignee: Provera GmbH, Meersburg (DE)

( * ) Notice: Subject to any disclaimer, the term of this patent is extended or adjusted under 35 U.S.C. 154(b) by 0 days.

(21) Appl. No.: 10/247,651

(22) Filed: Sep. 19, 2002

(65) Prior Publication Data

US 2003/0104718 A1 Jun. 5, 2003

(30) Foreign Application Priority Data

Dec. 4, 2001 (DE) ..... 101 59 309

(51) Int. Cl.[7] ..... H01R 13/627
(52) U.S. Cl. ..... 439/356; 439/307; 362/255
(58) Field of Search ..... 439/356, 304–307; 362/255–260

(56) References Cited

U.S. PATENT DOCUMENTS 4,577,265 A * 3/1986 Krause, Jr. ..... 362/255
4,750,892 A * 6/1988 Santopietro ..... 439/307
5,044,974 A * 9/1991 Pelton et al. ..... 439/307
5,199,783 A * 4/1993 Pelton ..... 362/260
5,788,525 A * 8/1998 Newman et al. ..... 439/307
6,033,249 A 3/2000 Holzer ..... 439/356
6,036,522 A * 3/2000 Holzer ..... 439/306

* cited by examiner

*Primary Examiner*—Michael C. Zarroli
(74) *Attorney, Agent, or Firm*—Marshall, Gerstein & Borun LLP

(57) ABSTRACT

The invention pertains to an adaptor for inserting lamps with pin bases into screw bases, the task of which is to make it impossible to screw out the adaptor without special tools after it has been inserted into the screw base.

This task is achieved by the invention by arranging the thread of the adaptor on a loosely rotating threaded bushing which can be rigidly connected with the adaptor body by means of a key before screwing in the adaptor. After the adaptor has been screwed in and the key has been removed, the threaded bushing cannot be removed from the socket.

10 Claims, 2 Drawing Sheets

ADAPTOR FOR SHOCKPROOF SOCKET

FIELD OF THE DISCLOSURE

This disclosure relates generally to electrical devices and, more particularly, to an adaptor for a light bulb socket.

BACKGROUND

Electrical and electronic devices are subject to stringent safety standards. Generally, in order to be marketed, an electrical device must be shown to comply with protocols established by an independent testing agency (e.g., Underwriters Laboratories in the United States). The major exception to this principle are light bulbs, which are still manufactured and used in a form virtually unchanged since Edison's time. For over 130 years, the vast majority of light bulbs manufactured and sold in the United States have employed threaded or "Edison" sockets, even though these sockets are recognized to constitute a shock hazard. Even the so-called bayonet socket, developed later, provides some risk of electrical shock during the process of light bulb replacement. Although in recent years, shockproof connectors employing pin bases have been provided for some types of fluorescent lamps, these systems have not been universally adapted—not in the United States nor in the rest of the world.

This situation persists, notwithstanding the recommendations of a committee of international testing agencies, acting worldwide, which has been in existence for 22 years, and has developed suggestions and guidelines for future designs of shockproof base socket systems. So far, however, with one exception (U.S. Pat. No. 6,033,249), no design has been presented which would satisfy all conditions or stipulations of the so-called "requirement catalog" adopted by this committee.

The important condition which says that lamps with "new" bases must be insertable into approximately 60 billion existing lamp sockets by means of an "adaptor" is hard to satisfy, in particular because of a further requirement saying that such adaptor, after having been screwed into the socket, should be impossible to screw out of the socket without a special tool.

SUMMARY OF THE INVENTION

This task is solved by the present invention by designing the outer thread of the adaptor as a loose threaded, electrically conductive bushing and arranging it on the adaptor body in an easily rotating manner.

By means of a bolt, designed similarly to a key, the rotating threaded bushing can be connected rigidly with the adaptor body, and the adaptor body can then be screwed into the thread of the Edison socket. The rigid connection can be achieved either by providing holes and ribs in the threaded bushing, which are engaged by the "key", or by providing a wedge which simply wedges together the outer thread with the adaptor body by means of a key.

After inserting the adaptor, the key is taken out, the threaded bushing is freely rotating again and the lamp may be inserted into the adaptor, but the lamp cannot be "screwed out" out of the socket anymore; it can only be "pulled out" from the pin socket.

The adaptor is advantageously equipped with a shockproof pin contact system, for example, apparatus according to the aforementioned U.S. Pat. No. 6,033,249 (the text of which is hereby incorporated by reference herein) or a similar system. An advantage of pin contact systems is that the electrically "hot" contacts are recessed to prevent incidental bodily contact when inserting or removing light bulbs.

Another advantage of the invention is that different threaded bushings can be put on the adaptor body, so that the same adaptor body can be used with E27 threads for Europe or with E26 threads for America, for example.

Thus, the present invention provides a socket assembly which can be screwed into a conventional Edison socket to retrofit the Edison socket assembly for use with lamps (light bulbs) having pin connectors.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

BRIEF DESCRIPTION OF THE DRAWINGS

Below is a detailed description of the invention and of an exemplified embodiment.

Figure 1:
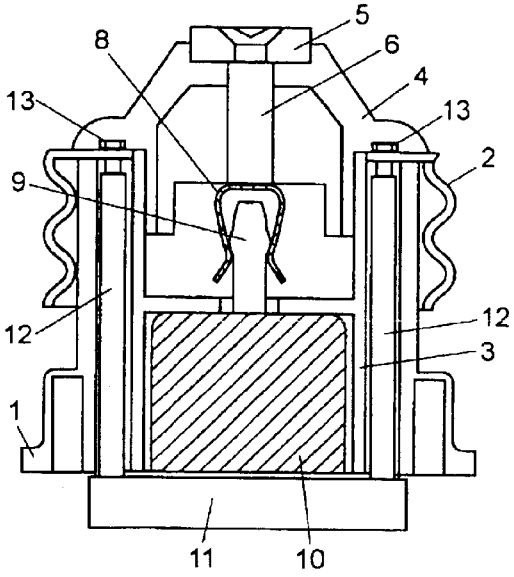
FIG. 1 shows a cross-section of the light socket adaptor with the insertion and removal key in place.
Figure 2:
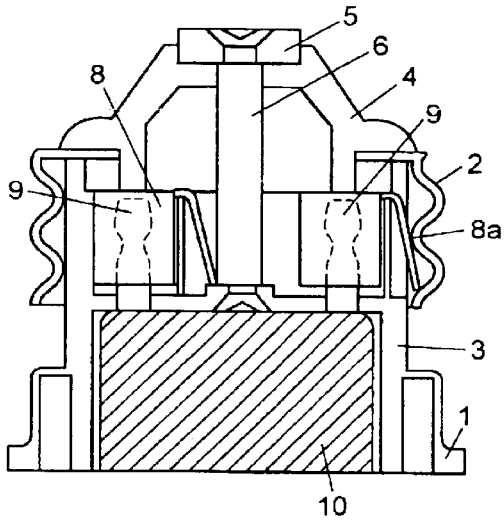
FIG. 2 shows a cross-section of the adaptor transposed by 90°, and with the key removed.
Figure 3:
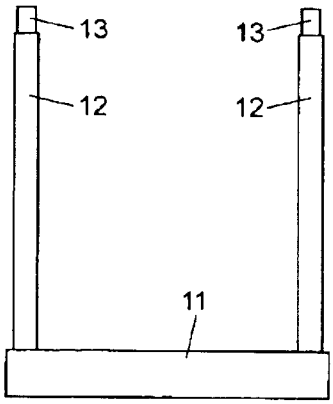
FIG. 3 shows a key for connecting the parts in a rigid manner.

First a description of the sections in FIG. 1 and FIG. 2.

DETAILED DESCRIPTION OF A PREFERRED EMBODIMENT

Figure 4:
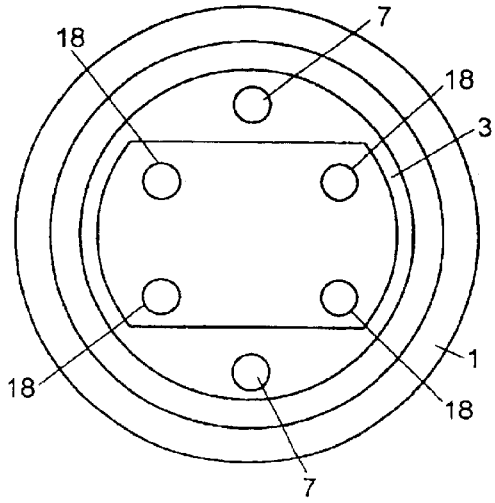
FIG. 4 shows a view of the adaptor from the pin contact side.

Referring now to FIGS. 1 & 2, a socket assembly is shown comprising an adaptor body (1), the base of which is surrounded by a conductive threaded bushing (2) in a manner allowing rotation of the adapter within the bushing. Adaptor body (1) comprises of two insulator parts—a socket part (3) and a head part (4)—and an electrically-conductive middle contact (5). The socket part (3) is riveted or screwed to the head part (4) by means of a post (6), whereby the post (6) is advantageously made of a conductive material and electrically connects the middle contact (5) with one of the socket contacts (8) mounted in pin receptors (18) [FIG. 4].

In FIG. 1, the socket contact (8) is shown as a so-called tuning fork contact, but according to the invention it can be designed in any other form of a springable contact.

FIG. 2 shows the second socket contact (8) as well, establishing the electrical connection to the loosely rotating threaded bushing (2). From this example it becomes apparent that both socket contacts (8) may be designed identically to form a shape which is appropriate for the contact pins (9) of a light bulb to be mounted in the socket through pin receptors (18). One of the elastically springable bases **(8*a*) of the socket contacts (8) touches the post (6) and the, other one touches the inner surface of the threaded bushing (2). Obviously, the socket contact (8), which establishes the electrical contact to the rotating threaded bushing (2)**, should not block its movement.

For better understanding, both in FIG. 1 and FIG. 2 a light bulb base (10) having a pair of contact pins (9) is shown in the inserted condition (i.e., as if a light bulb were mounted in the socket assembly). FIG. 1 also shows a key (11) inserted into the socket assembly. Of course, when a light bulb is mounted in the socket assembly, the key (11) and the lamp with its lamp base (10) may not be inserted into socket part (3) at the same time. The body of the light bulb (not shown) would block key (11).

In order to insert the adaptor into the Edison screw socket, first the key (11) with its two key fingers (12) must be inserted into the two key holes (14) of the adaptor, until the key pins (13) located at the end engage two of the diametrically opposing holes (14) of the threaded bushing (2). According to the invention, a single key pin would be sufficient as well, but a symmetrical design helps to avoid a jamming or damage to the threaded bushing (2).

Figure 5:
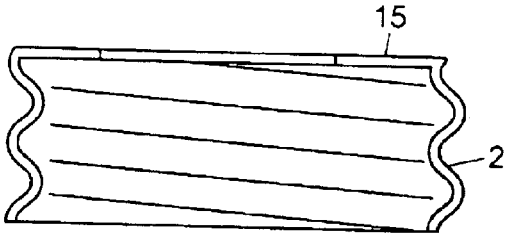
FIG. 5 is a lateral view of the threaded bushing.
Figure 6:
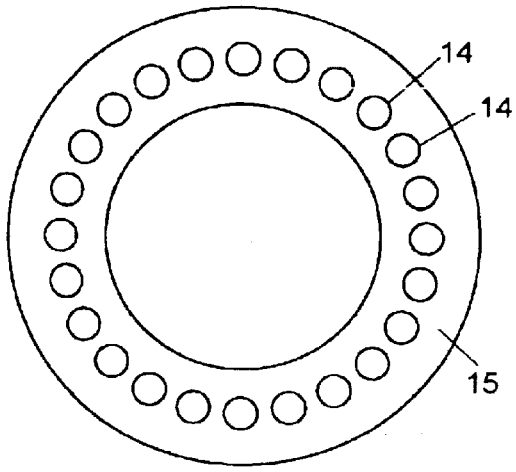
FIG. 6 shows a top view of the threaded bushing.

FIG. 5 shows, how easily the threaded bushing (2) can be executed. In the upper edge (15) of key (11), there are a multitude of holes (14) which can be engaged by the key pins (13) in order to connect the threaded bushing (2) with the adaptor body in a rigid manner.

Figure 7:
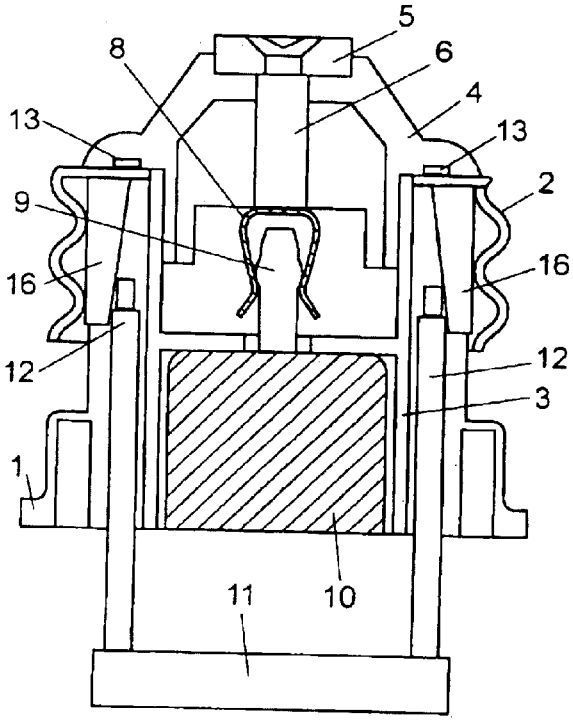
FIG. 7 shows an alternative embodiment of the light socket adapter employing a wedge.

FIG. 7 shows another variation of how the loose threaded bushing (2) can be rigidly connected to the adaptor body. In this example, a wedge-shaped bolt (16) is arranged between the inner wall of the threaded bushing (2) and the key finger (12). When the key (11) is inserted, the bolt (16) simply jams the threaded bushing (2) with the adaptor body (1). Numerous other solutions are possible for this type of forced rigid connection which solve the task according to the invention, and are thus indirectly included in the scope of protection of this patent.

ADAPTOR FOR SHOCKPROOF SOCKET
LEGEND

| | |
|---|---|
| 1 | Adaptor body |
| 2 | Threaded bushing |
| 3 | Socket part |
| 4 | Head part |
| 5 | Middle contact |
| 6 | Post |
| 7 | Key holes |
| 8 | Socket contact |
| 9 | Contact pins |
| 10 | Lamp base |
| 11 | Key |
| 12 | Key finger |
| 13 | Key pins |
| 14 | Holes |
| 15 | Upper edge |
| 16 | Wedge-shaped bolt |
| 18 | Pin receptor |

What is claimed is:

1. An adaptor for inserting lamps having pin sockets into screw sockets, said adaptor comprising:

an adaptor body;

said adaptor body comprising a head end for insertion into a socket and a socket end for engaging a light bulb;

said adaptor body having perforations along a diameter;

a conductive threaded bushing coupled to said adaptor body;

said bushing being freely rotatable about an axis of said adaptor body;

said bushing being perforated along a diameter wherein each perforation of said bushing aligns with a perforation of said adaptor body;

a removable key comprising a base with at least two prongs spaced symmetrically about said base;

said prongs being able to engage said perforations of said adaptor body and said bushing from within the adaptor body.

2. The adaptor of claim 1, wherein said bushing is attached closer to said head end than said socket end of said adaptor body.

3. The adaptor of claim 1, wherein said socket end of said adaptor body comprises a flange portion integrally formed with said adaptor body, said flange portion having a diameter wider than a diameter of said bushing.

4. The adaptor of claim 1, wherein said socket end comprises a contact system for engaging pins of a light bulb.

5. The adaptor of claim 4, wherein said contact system is designed as a pin contact system.

6. An adaptor for inserting lamps having pin sockets into screw sockets, said adaptor comprising:

an adaptor body;

said adaptor body comprising a head end for insertion into a socket and a socket end for engaging a light bulb;

a conductive threaded bushing coupled to said adaptor body;

said bushing being freely rotatable about an axis of said adaptor body;

a wedge-shaped bolt being disposed between said adaptor body and said bushing;

a removable key comprising a base with at least two prongs spaced symmetrically about said base;

said prongs being able to engage and lock said wedge with said adaptor body and said bushing from within the adaptor body.

7. The adaptor of claim 6, wherein said bushing is attached closer to said head end than said socket end of said adaptor body.

8. The adaptor of claim 6, wherein said socket end of said adaptor body comprises a flange portion integrally formed with said adaptor body, said flange portion having a diameter wider than a diameter of said bushing.

9. The adaptor of claim 6, wherein said socket end comprises a contact system for engaging pins of a light bulb.

10. The adaptor of claim 9, wherein said contact system is designed as a pin contact system.

* * * * *